US008853932B2

(12) United States Patent
Kar et al.

(10) Patent No.: US 8,853,932 B2
(45) Date of Patent: Oct. 7, 2014

(54) FILAMENT INCLUDING CARBON NANOTUBES AND METHOD OF MAKING A FILAMENT INCLUDING CARBON NANOTUBES

(75) Inventors: Kamal Krishna Kar, Kanpur (IN); Raghunandan Sharma, Kanpur (IN); Ariful Rahman, Kanpur (IN); Sanjay Agarwal, Kanpur (IN)

(73) Assignee: Indian Institute of Technology Kanpur, Uttar Pradesh (IN)

( * ) Notice: Subject to any disclaimer, the term of this patent is extended or adjusted under 35 U.S.C. 154(b) by 76 days.

(21) Appl. No.: 13/017,303

(22) Filed: Jan. 31, 2011

(65) Prior Publication Data

US 2012/0074832 A1 Mar. 29, 2012

(30) Foreign Application Priority Data

Sep. 23, 2010 (IN) ..... 2276/DEL/2010

(51) Int. Cl.

| | |
|---|---|
| ***H01K 1/04*** | (2006.01) |
| ***H01J 9/04*** | (2006.01) |
| ***H01K 3/02*** | (2006.01) |
| ***H01K 1/10*** | (2006.01) |

(52) U.S. Cl.

CPC ... *H01K 1/10* (2013.01); *H01K 3/02* (2013.01)
USPC ..... 313/355; 313/557; 313/569; 313/577

(58) Field of Classification Search

USPC ..... 313/355; 445/48; 977/950
See application file for complete search history.

(56) References Cited

U.S. PATENT DOCUMENTS

| | | | | |
|---|---|---|---|---|
| 223,898 | A | 1/1880 | Edison | |
| 6,949,877 | B2 * | 9/2005 | Sun et al. | 313/491 |
| 7,375,458 | B2 | 5/2008 | Kornilovich et al. | |
| 7,492,088 | B2 | 2/2009 | Jang et al. | |
| 2002/0165091 | A1 * | 11/2002 | Resasco et al. | 502/255 |
| 2004/0051432 | A1 | 3/2004 | Jiang et al. | |
| 2006/0022568 | A1 | 2/2006 | Kornilovich et al. | |
| 2008/0157649 | A1 | 7/2008 | Wei et al. | |

OTHER PUBLICATIONS

"Light emission of double-walled carbon nanotube filaments doped with yttrium and europium" SHU QinKe et al. Sci China Ser E-Tech Sci | Jan. 2009 | vol. 52 | No. 1 | 252-255.*

(Continued)

*Primary Examiner* — Nimeshkumar Patel
*Assistant Examiner* — Jacob R Stern
(74) *Attorney, Agent, or Firm* — Dorsey & Whitney LLP

(57) ABSTRACT

Techniques described herein generally relate to methods of manufacturing devices and devices including a filament having therein or coated with a catalyst and carbon nanotubes. The device may be configured to produce light with a luminary characteristic having a value higher than a value of the luminary characteristic of a device having an uncoated filament at a same operating condition. The luminary characteristic may include one or more of device irradiance or light efficiency. The filament may be a tungsten filament, and the carbon nanotubes may include multiwall carbon nanotubes or single wall carbon nanotubes. The filament may be coated with the carbon nanotubes using one or more deposition techniques including electric arc discharge, laser ablation and chemical vapor deposition (CVD). The filament may be coated with the catalyst using a method including one or more of electroless plating, electroplating, dip coating, spin coating, and radio frequency (RF) sputtering.

17 Claims, 16 Drawing Sheets

(56) References Cited

OTHER PUBLICATIONS

Ferrer, D. et al., "Enhancement of field emission characteristics of tungsten emitters by single-walled carbon nanotube modification", Applied Physics Letters, Jan. 2006, vol. 88, Issue 03, pp. 53-76 (Chapter 4).
Iijima, "Helicol Microtubules of Graphitic Carbon", Nature, Nov. 1991, 354, 56-58.
Li et al., "Luminescence of Carbon Nanotube Bulbs", Chinese Science Bulletin, Jan. 2007, 51(1), 113-117.
Liu et al., "Thermionic Emission and Work Function of Multiwalled Carbon Nanotube Yarns", Physical Review B, 2006, 73(235412), 1-5.
Mintmire et al., "Are Fullerene Tubules Metallic", Physical Review Letters, 1992, 68, 631-634.
Saito et al., "Electronic Structure of Chiral Graphene Tubules", Applied Physics Letters, May 1992, 60(18), 2204-2206.
Shu et al., "Low Voltage Energy-Saving Double-Walled Carbon Nanotube Electric Lamps", Journal of Applied Physics, 2007, 101(084306, 1-4.
Wei et al., "Reliability and Current Carrying Capacity of Carbon Nanotubes", Applied Physics Letters, 2001, 79(8), 1172-1174.
Zhao et al., "Light Emission and Degradation of Single-Walled Carbon Nanotube Filament", IEEE Explore, Aug. 2005, 98(044306), 1-4.

* cited by examiner

FILAMENT INCLUDING CARBON NANOTUBES AND METHOD OF MAKING A FILAMENT INCLUDING CARBON NANOTUBES

CROSS-REFERENCE TO RELATED APPLICATIONS

The present application claims priority to a corresponding patent application filed in India and having application number 2276/DEL/2010, filed on Sep. 23, 2010, the entire contents of which are herein incorporated by reference.

BACKGROUND

Unless otherwise indicated herein, the materials described in this section are not prior art to the claims in this application and are not admitted to be prior art by inclusion in this section.

In 1880 Thomas Edison invented the light bulb using a carbon filament. Edison's light bulb provided 40 hours of light in an oxygen-free environment ushering in the electric lighting era. The carbon filament, however, has low reliability at high operating temperatures. To replace the carbon filament, more than 40 elements have been tested as a filament material. In 1910, William D. Coolidge successfully substituted a tungsten filament in light bulbs for Edison's carbon filament.

Incandescent light bulbs, however, provide light via black-body (thermal generated) radiation. The visible light of a typical vacuum tungsten light bulb is approximately 5% of the total radiation. Thus, a majority of electrical energy to operate the bulb is converted to heat. Increasing the operating temperature increases efficiency, however, this method of increasing the efficiency is limited by the melting temperature of tungsten.

Sodium lamps are more efficient than tungsten lamps, but their light is essentially monochromatic and not pleasing to the human eye. Light-emitting diodes are not widely used currently because of their complicated fabrication technique and high processing cost.

SUMMARY

Some embodiments relate to a device configured, for example, to produce light. Some example devices include a filament having carbon nanotubes. These devices may be configured such that they produce light with a luminary characteristic having a value higher than a value of the luminary characteristic of a device having an uncoated filament at a same operating condition.

Some embodiments relate to a method including making a device with a filament having carbon nanotubes. These devices may be configured such that they produce light with a luminary characteristic having a value higher than a value of the luminary characteristic of a device having an uncoated filament at a same operating condition.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

Embodiments are shown in the drawings, in which like reference numerals designate like elements.

DETAILED DESCRIPTION OF ILLUSTRATIVE EMBODIMENTS

Multiwall carbon nanotube (CNT), single wall CNT, and mixtures of multiwall and single wall CNT-coated tungsten substrates have been developed for use as a filaments for incandescent light bulbs. Embodiments include a light bulb in which the conventional tungsten filament is replaced by a CNT-coated tungsten filament. Embodiments of CNT-coated tungsten filaments exhibited higher lighting efficiency, higher brightness and a lower threshold voltage for light emission as compared to conventional tungsten filaments. In an embodiment, CNTs were grown on transition metal catalyst-coated tungsten substrate by thermal chemical vapor deposition (CVD) method. In alternative embodiments, other methods of growing CNTs, may be used.

Various processing conditions including catalyst concentration, time, temperature, and pH of coating solution, flow rates of inert gas, carbon containing gas and reducing gas, etc. have been investigated. Luminescence properties like relative efficacy (lux/watt), irradiance, and the I-V characteristics of CNT-coated light bulbs have been measured and compared with light bulbs with uncoated tungsten filaments. Results show that the CNT-coated filament in an incandescent light bulb improves efficiency and energy saving and it can be a good candidate as incandescent light source.

Carbon nanotubes have been reported in the literature since 1991, and have been shown to have excellent electrical properties, including field emission, thermionic emission and work function. Additionally, CNTs are reported to be stable at certain temperatures in oxygen-free atmosphere. Use of straight, continuous single wall and double wall CNTs as filaments in light bulbs and electric lamps has also been reported.

An embodiment provides a filament which includes a support material coated with a carbon product(s). In an embodiment, the support material is tungsten. Other support materials include but are not limited to, platinum, carbon, tantalum, and other suitable filament materials.

The carbon product may include single wall carbon nanotubes, multiwall carbon nanotubes, or a mixture of single wall and multiwall carbon nanotubes.

Figure 1:
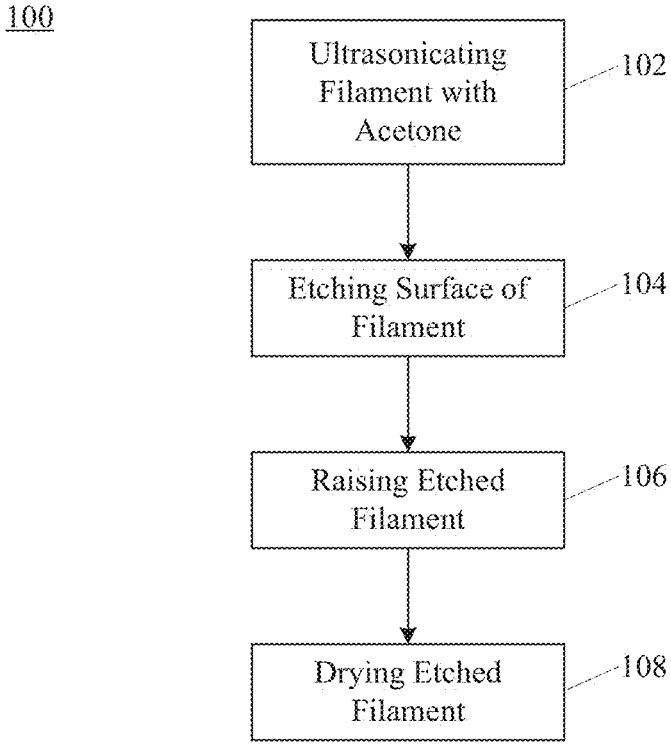
FIG. 1 illustrates an embodiment of a process for activating the surface 100.
Figure 2:
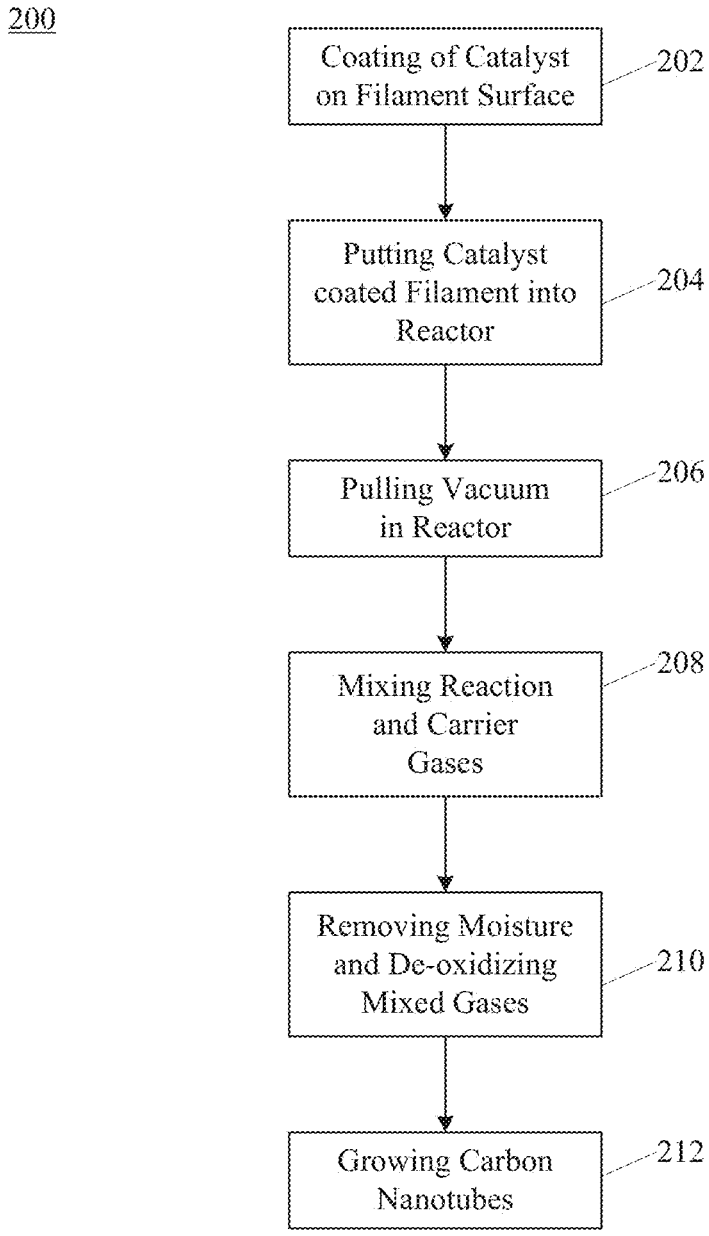
FIG. 2 illustrates an embodiment of a process of coating the activated surface with carbon nanotubes.

An embodiment of a process of making a carbon nanotube-coated filament includes steps of activating the surface of the support material and growing carbon nanotubes on the activated surface. FIG. 1 illustrates an embodiment of a process for activating the surface 100 while FIG. 2 illustrates an embodiment of a process of coating the activated surface with carbon nanotubes 200. The example process for activating the surface 100 illustrated in FIG. 1 includes the steps of: ultrasonicating the filament with acetone 102, etching the surface of the filament 104, rinsing the etched filament 106, and drying the etched filament 108. The filament is typically ultrasonicated 102 to remove contaminants and oily or fatty impurities from the surface of the substrate. The filament may be ultrasonicated 102, for example, for about 1 to about 10 minutes in a temperature range of about 25° C. to 90° C. Other times and temperatures may also be used.

In an embodiment, the filament may be etched 104 by dipping into an etching solution. The etching solution may include, for example, about 1 ml of about 30% solution of hydrogen peroxide ($H_2O_2$) in about 100 ml deionized water. In an embodiment, etching is performed for about 1 to about 5 minutes in a temperature range of about 25 to 90° C. Other times and temperatures may also be used. In an embodiment, the etched filament may be rinsed 106 in de-ionized water and ultrasonicated for about 1 to about 10 minutes. Other times may also be used. In an embodiment, the filament may be dried at about 60 to about 90° C. for about 1 to about 3 hours. Alternatively, the filament by be dried at higher or lower temperatures and/or for more or less time.

An example process of coating the activated surface with carbon nanotubes 200, illustrated in FIG. 2, may include the steps of: coating of catalyst on the surface of the filament 202, putting the catalyst coated filament into a reactor 204, pulling a vacuum in the reactor 206, mixing reaction and carrier gases 208, removing moisture and de-oxidizing the mixed gases 210, and growing carbon nanotubes 212. Coating of catalyst on the surface of the filament 202, may be performed with a range of operating conditions including, but limited to, a temperature from about 10° C. to about 90° C., a time period of about 10-3600 seconds, a pH of about 5 to 11, and various compositions of catalysts as discussed in more detail below.

The catalyst-coated filament may be put into the reactor 204, for example, by loading the catalyst-coated filament in a quartz boat, and inserting the quartz boat into the reactor. In an embodiment, pulling the vacuum in the reactor 206 may be performed by reducing the pressure to less than about 200 mm Hg.

Mixing reaction and carrier gases 208 may be performed in a separate mixing chamber prior to introducing the gases into a reaction chamber. Alternatively, mixing reaction and carrier gases 208 may be performed in a manifold. In an embodiment, the method includes a step of removing moisture and de-oxidizing the mixed gases 210. Alternatively, the gases may have the moisture removed and be de-oxidized prior to mixing. Growing the carbon nanotubes 212 may be performed under different conditions (temperature, gas mixtures, etc.) as discussed in more detail below.

Filaments according to one or more embodiments include: continuous monofilaments, continuous flat multifilaments, continuous twisted multifilaments, continuous textured multifilaments and coiled filaments. Discontinuous filaments may be filaments that are less than 10 mm in length. Continuous filaments may be filaments that are 10 mm or more in length. In an embodiment, the diameter of the filament varies from about 0.0030 cm to about 0.0102 cm. In other embodiments, the filament may have larger diameters.

In an embodiment, the catalyst includes one or more Group VIII metals such as Ni (Nickel), Ru (Ruthenum), Rh (Rhodium), Pd (Palladium), Ir (Iridium) and Pt (Platinum) and/or mixtures or alloys thereof. Alternatively, the catalyst includes one or more Group VIb metals such as Cr (Chromium), Mo (Molybdenum) and W (Tungsten) and/or mixtures or alloys thereof. Alternatively, the catalyst includes mixtures and/or alloys of group VIII metals and group VIb metals. The catalyst may be in a ratio of one part of group VIb metal to at least 2 or more part of metal from group VIII.

Coating Filaments with Catalyst

The catalyst(s) may be coated on the filament via a number of different methods. For example, the catalyst may be coated using an electroless dip coating process. In an embodiment using a dip coating process, the oxidizing agents used in dip coating include metals, metal sulfides, metal disulifides, metal halides and metal sulphates. In this embodiment, the metals may include group VIII metals such as Ni, Ru, Rh, Pd, Ir, and group VIb metals such as of Cr, Mo, W and as well as mixtures and alloys of these metals. Reducing agents in this embodiment may include metals such as Na, Mg, Al, Zn, Cu and mixtures thereof, metal hydrides of Na, Mg, Al, Zn, Cu and mixtures thereof, and metal hypophosphites of Na, Mg, Al, Zn, Cu and mixtures thereof. Chelating agents in this embodiment may include water, carbohydrates, including polysaccharides, organic acids with more than one coordination group lipids, steroids, amino acids and related compounds, peptides, phosphate, nucleotides, tetrapyrrois, ferrioxamines, ionophores, such as gramicidin, monensin, valinomycin, phenolics, 2,2'-bipyridyldimercaptopropanol, ethylenedioxydiethylene-dinitrilo-tetraacetic acid, ethylene, glycol-bis(2-aminoethyl)-N,N,N',N"-tetraacetic acid, lonophores-nitrilotrriacetic acid, NTA ortho-Phenanthroline, salicylic acid, triethanolamine, sodium succinate, sodium acetate, ethylene diamine, ethylenediaminetetraacetic acid, dethylenetriaminepentaacetic acid, ethylenedinitrilotetraatic acid, and mixture thereof.

In this embodiment, the electroless dip solution may include a buffer. The buffer may include a weak acid, its salt and mixture thereof. Example weak acids include but are not limited to succinic acid, formic acid, acetic acid, tricholoroacetic acid, hydrofluoric acid, hydrocynic acid, hydrogen sulphide, and water. The buffer may also include sodium and/or potassium salts of succinic acid, formic acid, acetic, trichoroacetic acid, hydrofluoric acid, and hydrocynic acid. The buffer may also include hydrogen sulphide.

In an embodiment, electroless dip coating is carried out in an atmosphere that includes nitrogen, argon, helium or mixtures of these gases. Further, electroless dip coating may be carried out, for example, at a temperature of about 10-90° C. for a time period of about 10-3600 seconds. Under these process conditions, a catalyst layer may be with a thickness of about 50-200 nm may be obtained.

In an embodiment, the filament is dipped in an acidic/basic bath prepared by dissolving an oxidizing agent in de-ionized water having a ratio of about 1:100 to about 9:100 to which is added a reducing agent (ratio range of about 1:1 to 1:5, by weight), a chelating agent (ratio range of about 1:1 to 1:10) and a buffer (ratio range of about 1:0.10 to 1:1) followed by stirring of the mixture to obtain the acidic/basic bath. An example spraying solution is provided in Table 1 below.

TABLE 1

Composition for coating of nickel on tungsten filament

| Composition of both | Specifications |
|---|---|
| $NiSO_4 \cdot 6H_2O$ (g/L) | 30 |
| $NaH_2PO_2 \cdot H_2O$ (g/L) | 12 |
| $NH_4CI$ (g/L) | 50 |
| $Na_3C_6H_5O_7 \cdot 2H_2O$ (g/L) | 15, 25, 35, 45, and 55 |
| $NH_3 \cdot H_2O$ (ml) | Alkalinity reserve |
| pH | 6, 7, 8, 9 and 10 |
| Coating temperature (° C.) | (50, 60, 70, 80, and 90) ± 1° C. |
| Coating times (mins) | 0, 5, 10, 15, 25 and 30 |

Figure 3:
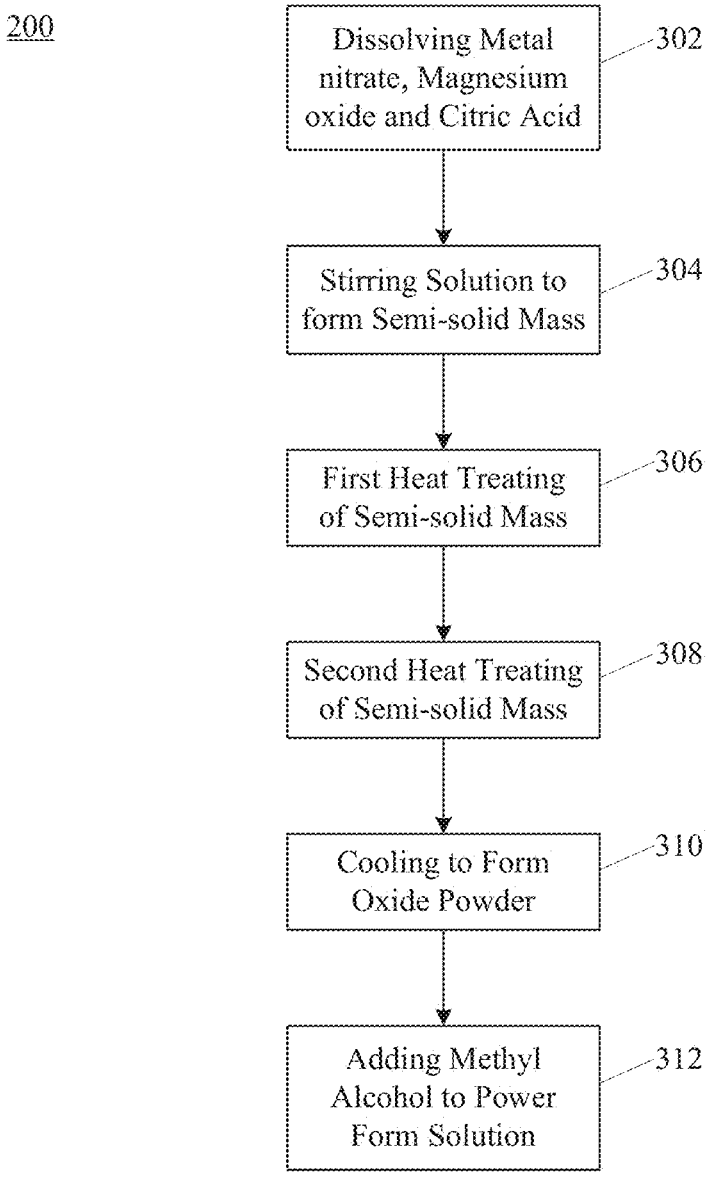
FIG. 3 illustrates an embodiment of a process of making a spray solution.

In another embodiment, coating of the catalyst on the filament may be carried out by spray coating a solution on the filament. A method 300 of making the spray solution is illustrated in FIG. 3.

The solution may be prepared by a method 300 that includes the steps of: dissolving a metal nitrate, magnesium oxide and citric acid 302, stirring the solution to form a semi-solid mass (i.e., a matter having a rigidity and viscosity intermediate between a solid and a liquid) 304, a first heat treating of the semi-solid mass 306, a second heat treating of the semi-solid mass 308, cooling to form oxide powder 310, adding methyl alcohol to powder form solution 312. In an embodiment, the metal nitrate, magnesium oxide and citric acid are provide in a ratio of about 1:1:4 by weight, and dissolved in 100 ml of de-ionized water. Other ratios may also be used. Stirring the solution to form a semi-solid mass 304 may be performed, for example, at a temperature of about 80° C. for about 6 hours. Other times and temperatures may be used. Typically, when stirring at a lower temperature, stirring is performed for a longer time while stirring at a higher temperature is performed for a shorter time.

The first heating treating of the semi-solid mass 306 may be performed, for example, in an oven at a temperature of about 120° C. for a period of about 2 hours. Other temperatures and times may be used. The second heat treating of the semi-solid mass 308 may be performed, for example, in a furnace at a temperature of about 300° C. to 700° C. for a period of about 5 hours in air. The time may be longer or shorter than 5 hours. Generally, heat treating at higher temperatures allows for shorter heat treatment times. The product of this step is a powder of mixed nickel and magnesium oxides. The cooling step 310 may be performed at any rate. Cooling may be accomplished by air cooling, forced air cooling, or any other cooling technique. The addition of methyl alcohol to the powder may be accompanied with stirring to form the solution 312.

An example dip coating specifications is provided in Table 2 below.

TABLE 2

Composition for coating of cobalt on tungsten filament

| Composition of both | Specifications |
|---|---|
| $CoSO_4 \cdot 7H_2O$ (g/L) | 35 |
| $NaH_2PO_2 \cdot H_2O$ (g/L) | 10 |
| $NH_4CI$ (g/L) | 50 |
| $Na_3C_6H_5O_7 \cdot 2H_2O$ (g/L) | 25 |
| $NH_3 \cdot H_2O$ (ml) | Alkalinity reserve |
| pH | 8.5 |
| Coating temperature (° C.) | (60, 70, 80, and 90) ± 1° C. |
| Coating times (mins) | 5, 10, 15, 25 and 30 |

Figure 4:
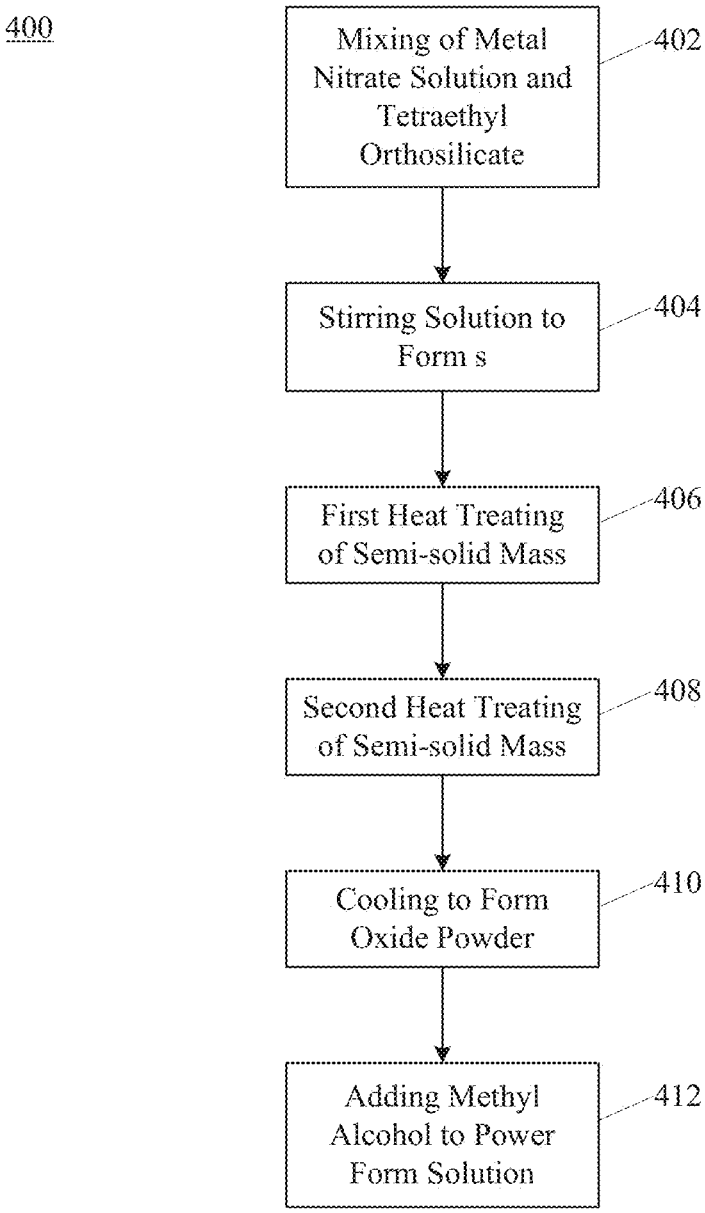
FIG. 4 illustrates an embodiment of another process of making a spray solution.

A method 400 of making the spray solution for a solution coating embodiment is illustrated in FIG. 4. The solution may be prepared by a method 400 that includes the steps of: mixing of metal nitrate solution and tetraethyl orthosilicate (TEOS) 402, stirring the solution to form a semisolid mass 404, a first heat treating of the semisolid mass 406, a second heat treating of the semisolid mass 408, cooling to form oxide powder 410, adding methyl alcohol to powder form solution 412. In an embodiment, the metal nitrate solution has a concentration of about 0.1M, the ratio of metal nitrate solution to TEOS is about 4:3 by volume, and the metal nitrate solution and TEOS are mixed with about 15 ml ethyl alcohol (total volume of about 50 ml). The step of stirring the solution to form a semi-solid mass 404 may be performed at a temperature of 25° C. for 45 minutes. Other temperatures and times may be used.

The first heat treating of the semi-solid mass 406 may be performed, for example, at a temperature of about 100° C. for a period of about 24 hours. Other times and temperatures may be used. The second heat treating of the semisolid mass 408 may be performed in a furnace at a temperature of 300 to 600° C. for a period of 5 hours. In example embodiments, heat treating at higher temperatures allows for shorter heat treatment times. The product of this step is a powder of mixed nickel and silicon oxides. The cooling step 410 may be performed at any rate. Cooling may be accomplished by air cooling, forced air cooling, or any other cooling technique. The addition of methyl alcohol to the powder may be accompanied with stirring to form the solution 412.

In other embodiments, other coating techniques may used to coat transition metal catalyst(s) on tungsten filament. Examples include, but are not limited to, electroplating, dip coating through sol-gel, spin coating through sol-gel, radio frequency (RF) sputtering, magnetron sputtering, electron beam evaporation, physical vapor deposition, thermal evaporation, chemical vapor deposition, combustion, co-precipitation, impregnation, and langmuir blodgett.

Characterization of Catalyst-Coated Filaments

In one or more embodiments, the catalyst-coated tungsten filament is characterized and analyzed using scanning electron microscope (SEM) (e.g., JSM-840 electron microscope) and energy dispersive X-ray (EDAX) analysis technique. Such analysis is used to analyze the transition metal(s), phosphorous and carbon content (e.g., in wt percentage) of the transition metal-coated tungsten filament. For EDAX analysis, the surface area of the filament may be magnified at least 100 times such that the entire area of the filament can be scanned. This magnified-area analysis enhances the reliability of the characterization results, unlike conventional techniques in which only a few randomly selected area spots are chosen for analysis. The results from EDAX analysis were quantified using the standard ZAF technique, where "Z" relates to the atomic number, "A" relates to the absorption, and "F" relates to the florescence correction factors used in X-ray analysis.

Figure 5:
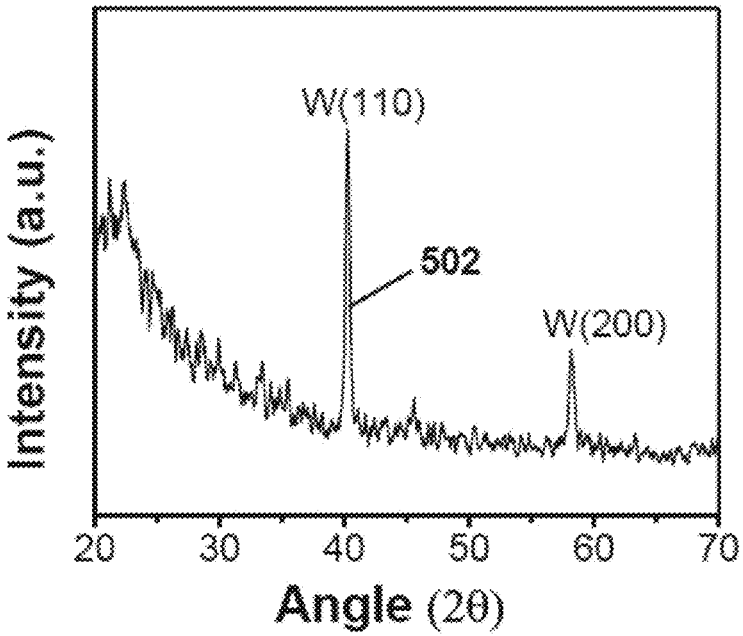
FIG. 5 shows a graph depicting a X-ray diffraction (XRD) pattern of an uncoated tungsten substrate.

FIG. 5 shows a graph 502 depicting a X-ray diffraction (XRD) pattern (in terms of intensity) of uncoated tungsten substrate. As is apparent, there are two peaks of tungsten material at 2θ of 40.26° in (110) direction, and at 58.27° in (200) direction (Joint Committee Powder Diffraction Standards (JCPDS) card No: 04-0806).

Figure 6:
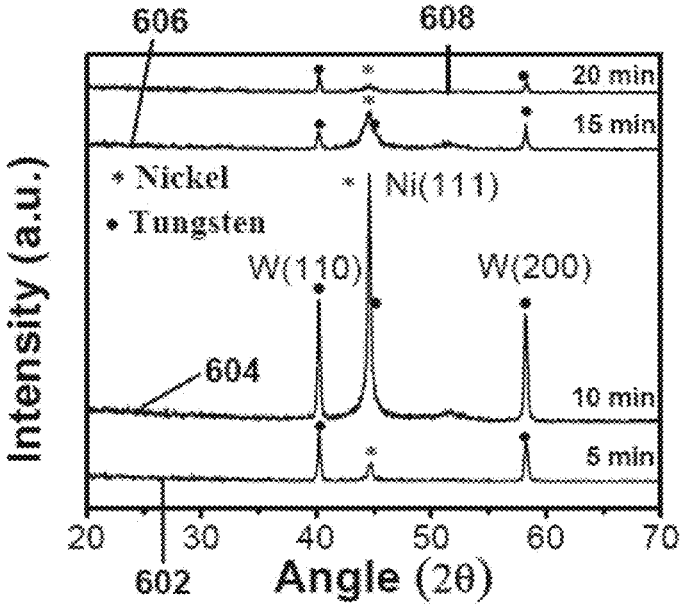
FIG. 6 shows various graphs depicting XRD patterns of catalyst-coated tungsten substrates for various coating times at a fixed coating temperature of 70° C.

FIG. 6 shows graphs depicting XRD patterns of nickel-coated tungsten substrates for various coating times at a fixed coating temperature of 70° C. As can be seen, the characteristic peak of Ni (111) is observed at 2θ of 44.59° (JCPDS card No: 04-0850). The presence of single peak reveals a focused orientation of the nickel film in the (111) direction. It is also seen that as the coating time is increased from 5 minutes (graph 602) to 10 minutes (graph 604), the intensity of the Ni (111) peak increases. However, beyond a 10-minute coating time, e.g., for coating time equal to 15 minutes (graph 606) or 20 minutes (graph 608), the intensity of the Ni (111) peak decreases considerably. At coating times greater than 10 minutes, it is also observed that the broadness of the Ni (111) peak increases, indicating the decrease in the grain size of Ni. Accordingly, in this example, it may be concluded that the optimal coating time with the temperature set at 70° C. is about 10 minutes.

Figure 7:
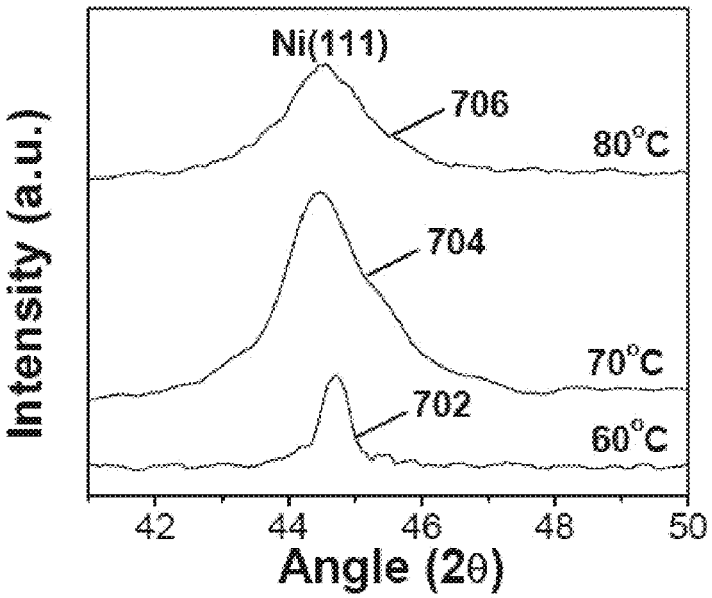
FIG. 7 shows various graphs depicting XRD patterns of catalyst-coated tungsten filament at different coating temperatures for a fixed coating time of 10 minutes.

In example embodiments, it was also observed that the temperature in the coating process plays a role in determining the rate and quality of the coating process. FIG. 7 shows graphs depicting XRD patterns of Ni-coated tungsten filament at different coating temperatures for a fixed coating time equal to 10 minutes. Graph 702 depicts intensity variation for 60° C. coating temperature, graph 704 depicts intensity variation for 70° C. coating temperature, and graph 706 depicts intensity variation for 80° C. coating temperature. It is seen through the experiments that the rate of deposition process increases with an increase in temperature and attains a maximum at a particular temperature. For temperatures beyond the temperature corresponding to the maximum deposition rate, the coating or deposition rate begins to reduce. This is because once the coating temperature reaches a certain point, some of the chemical species, i.e. concentration of ions present in the solution, may be altered and the chemical reaction may slow down or stop completely. For example, in experiments, the optimal performance of the coating process was observed for coating temperature equal to about 70° C. At higher temperatures, it was observed that it is too difficult to maintain the pH of the coating solution, and therefore the quality of the coating deteriorates.

Figure 8:
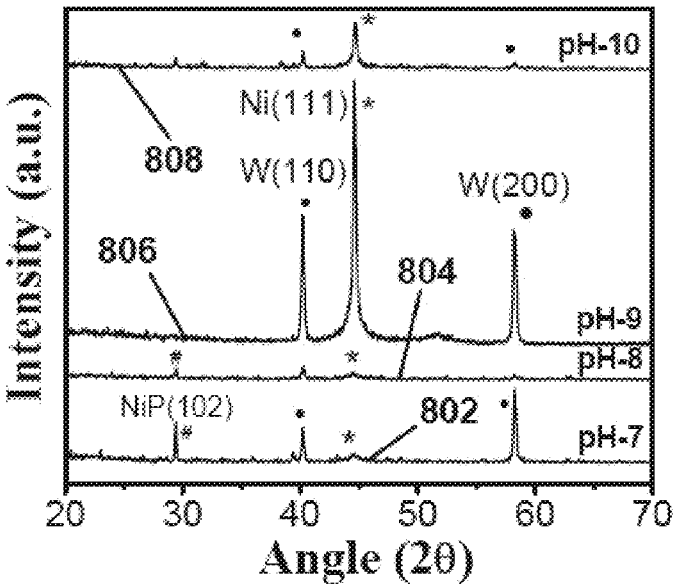
FIG. 8 shows various graphs depicting XRD patterns of catalyst-coated tungsten substrate for different pH values of the coating solution.
Figure 9:
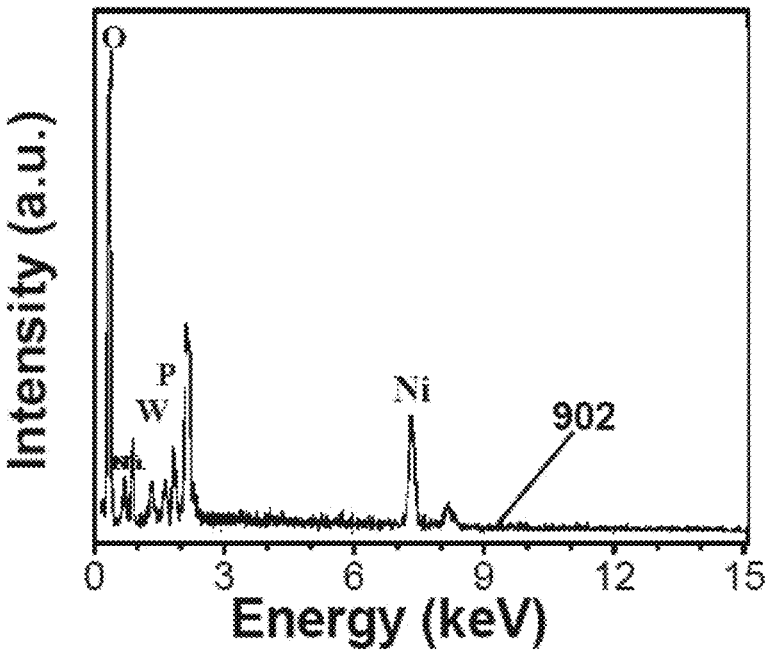
FIG. 9 shows a curve depicting EDAX analysis of catalyst-coated tungsten filament

In addition to coating temperature and coating time, in example experiments, it was seen that the pH value of the coating solution at which the reaction in the coating process occurs plays a role in the coating process kinetics, as well as in the composition of the coating. FIG. 8 shows graphs depicting XRD patterns of Ni-coated tungsten substrate (or filament) at different pH values of the coating solution. In this experiment, the coating time was fixed at 10 minutes, and the coating temperature was fixed at 70° C. As is apparent, at pH=7 (graph 802), it was observed that the XRD intensity peak of Ni—P (102) occurs at 2θ of 29.82° (JCPDS card No: 74-1382), which is stronger than the peak of Ni (111). This confirmed the increase in the deposited P on the tungsten substrate. In other words, the presence of stronger Ni—P peak indicates that the Ni—P film is strongly oriented in (102) direction as compared to the orientation of Ni film in (111) direction. As can also be seen, with the increase in pH value from 7 to 10 (graphs 802, 804, 806 and 808, respectively), Ni—P (102) peak intensity decreases, whereas Ni (111) peak intensity increases and attains a maximum for pH equal to 9. Accordingly, it is concluded that pH value equal to 9 provided better composition of Ni catalyst coating on tungsten substrate. FIG. 9 shows the EDAX analysis (curve 902) of Ni-coated tungsten filament. For this analysis, the weight percentage (wt %) of Ni, W and P are 50.26, 39.57 and 10.17% respectively.

Figure 10A:
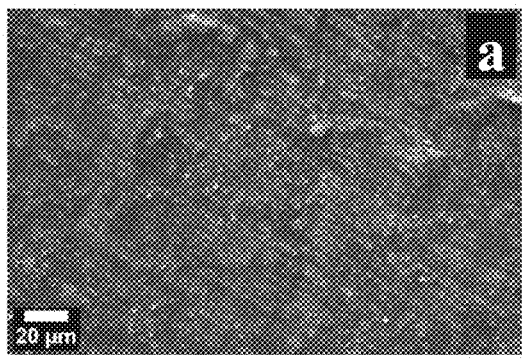
FIGS. 10*a-d* show micrographs obtained using a scanning electron microscope (SEM) for electroless catalyst coatings performed for 5, 10, 15, and 20 minutes.
Figure 10B:
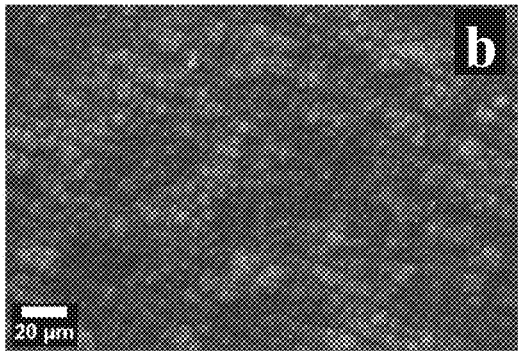
Figure 10C:
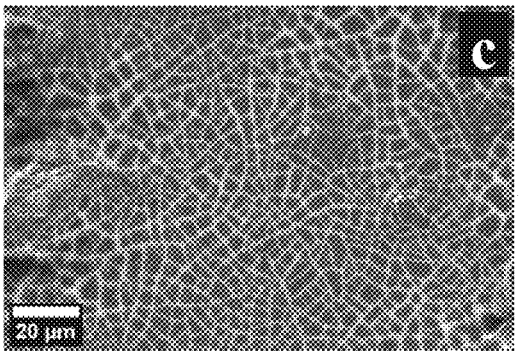
Figure 10D:
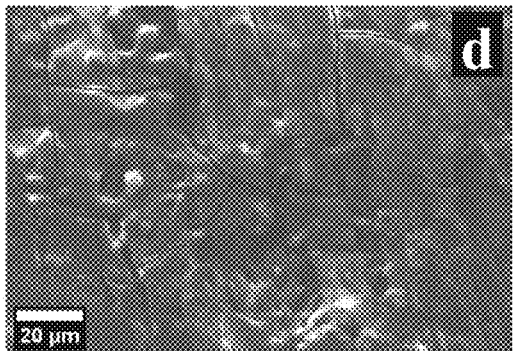

FIGS. 10*a-d* show micrographs obtained using a scanning electron microscope (SEM) for electroless NiP (catalyst) coatings performed for 5, 10, 15, and 20 minutes, respectively. It was observed that phosphorous content in the coating increases with the increase in the coating time. Some transverse cracks were also seen in the SEM micrographs for 15 and 20 minutes coating time (FIGS. 10*c* and 10*d*). Those cracks may be induced by the internal stresses, generated by the adsorption-desorption processes involved in the redox reactions and the co-deposition of phosphorous. Such internal stresses may alter the crystallographic structure of the nickel, and produce cracks in the coating.

Figure 11:
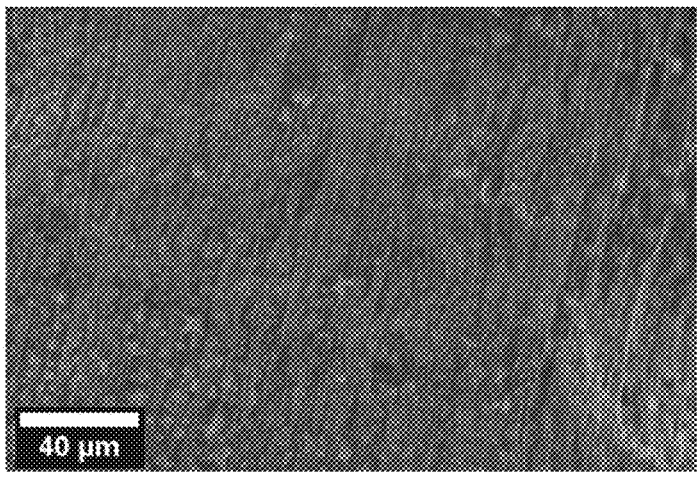
FIG. 11 shows an SEM micrograph of catalyst-coated tungsten substrates for a fixed coating time of 10 minutes and a fixed coating temperature of 70° C.
Figure 12:
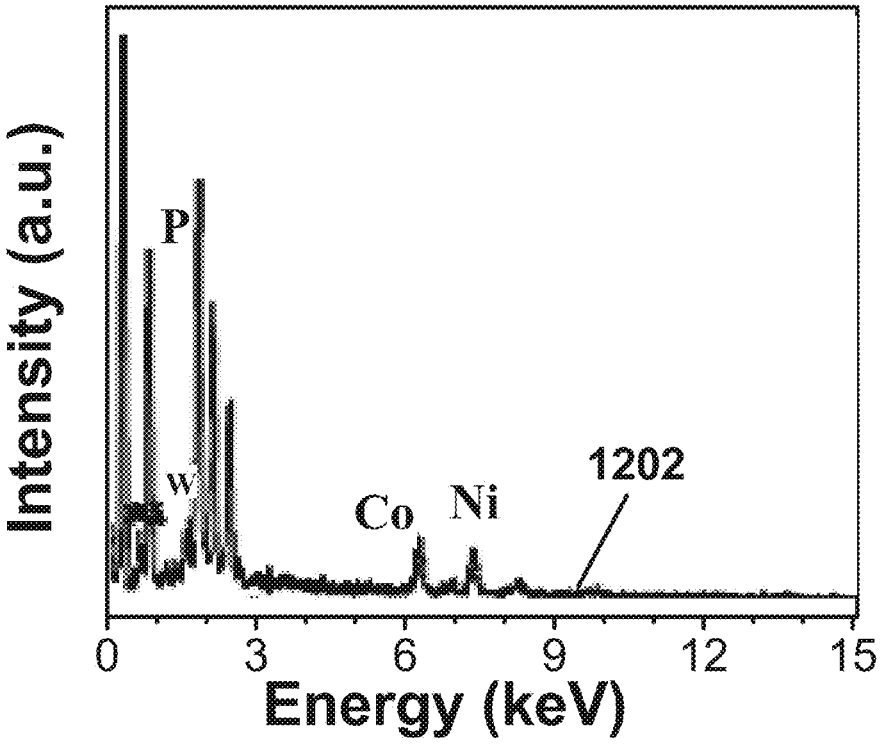
FIG. 12 a curve depicting EDAX analysis of catalyst-coated tungsten substrates for a fixed coating time of 10 minutes and a fixed coating temperature of 70° C.

The SEM and EDAX analysis of Ni—Co catalyst-coated tungsten substrates for a fixed coating time equal to 10 minutes and a fixed coating temperature equal to 70° C. are shown in FIGS. 11 and 12, respectively. As is apparent from FIG. 11, the SEM micrograph shows that the Ni—Co catalyst coating is uniform over the tungsten substrate. From EDAX analysis shown in graph 1202 of FIG. 12, the chemical composition of the Ni—Co catalyst-coated tungsten substrate is determined. Determining the chemical composition includes determining the amount of nickel, cobalt, and phosphorus in the coating. For Ni—Co catalyst coating, high nickel content was observed in the coating indicating that nickel composition is chemically more reactive with tungsten substrate than cobalt.

Coating CNTs on Catalyst-Coated Filaments

For growing or coating CNTs on a tungsten filament, any suitable technique may be used. In one embodiment, chemical vapor deposition (CVD) is used. The chemical vapor deposition technique makes use of the gases comprising of carbon containing gas such as group of saturated hydrocarbons, aliphatic hydrocarbons, oxygenated hydrocarbons, aromatic hydrocarbons, alcohols, carbon monoxide and mixture thereof; reducing gas such as group of gases hydrogen, chlorine and mixtures thereof; and diluent gas such as group of nitrogen, argon, helium and mixture thereof. In some embodiments, the ratio of reducing gas to diluent gas is about 0:100 to 50:50; the ratio of carbon containing gas to reducing gas to diluent gas is about 0:5:95 to 60:20:20; the ratio of carbon containing gas to diluent gas is about 0:100 to 60:40. Other ratios of these gases may be used.

Figure 13:
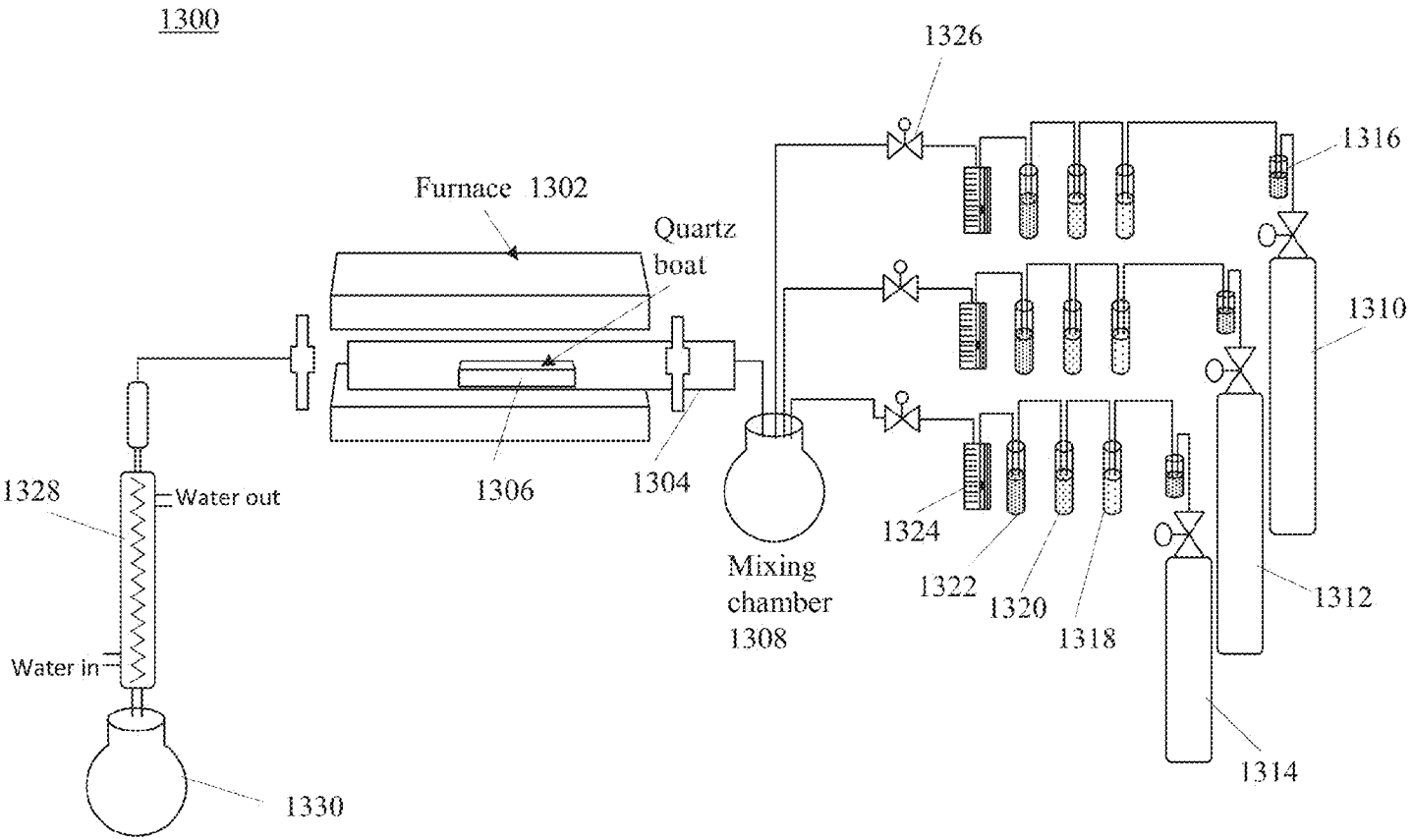
FIG. 13 is a schematic diagram of a system for coating carbon nanotubes on a catalyst-coated tungsten filament.

An example system 1300 for coating carbon nanotubes on a catalyst-coated tungsten filament using the CVD technique is shown in FIG. 13. As shown, system 1300 includes a furnace 1302, a reactor 1304, a quartz tube or boat 1306, a mixing chamber 1308, a carrier or inert gas cylinder 1310, a reducing gas cylinder 1312, a carbon-source gas cylinder 1314, containers 1316 having pyrogallol solution, containers 1318 having calcium chloride, containers 1320 having potassium hydroxide, containers 1322 having silica gel bed, rotameters 1324, valves 1326, a condenser 1328, and a collector 1330. To start the process of coating CNTs, a catalyst-coated tungsten filament (obtained after dip coating or spray coating catalyst on the filament) is placed within quartz tube 1306 of reactor 1304. Quartz tube 1306 may be of dimensions of about 1000 mm in length with an outer diameter of about 105 mm and inner diameter of about 100 mm. These or any other dimensions of quartz tube may be selected such that it is relatively easier to insert and remove the tungsten filament from reactor 1304. In one embodiment, the temperature of reactor 1304 is controlled by furnace 1302. Furnace 1302 may be a three-zone tubular furnace, and may include (or may be operatively connected) with a proportional temperature controller which controls furnace temperature in each of three furnace zones. The temperature controller may be configured to maintain temperature around 500° C. to 900° C. in the mid-zone of furnace 1302, e.g., in an area of reactor 1304 where quartz tube 1306 (and filament) is positioned. Such temperature range may facilitate the decomposition of various gases used in this CVD coating process. The temperature controller may be further configured to maintain temperatures in the range of about 300° C. to 600° C. toward the ends, i.e., the inlet and outlet, of furnace 1302 and/or reactor 1304. Other temperatures may be generated by furnace 1302 and provided to reactor 1304.

In one embodiment, after placing the catalyst-coated tungsten filament in the middle of reactor 1304, a vacuum is created in reactor 1304. Reactor 1304 may be connected to a vacuum line, the pressure in reactor 1304 may be reduced to less than about 200 mm Hg. This process may be repeated 10 or more times to completely remove oxygen from reactor 1304. Further, furnace 1302 may be activated to expose reactor 1304 to temperature in the range of about 400° C. to 600° C. in an inert atmosphere. Various precursor gases for the execution of the CVD process are then introduced into reactor 1304 from cylinders 1310, 1312 and 1314. For example, inert gas cylinder 1310 provides an inert gas such as nitrogen, helium, or argon; reducing gas cylinder 1312 provides a reducing gas such as hydrogen, or chlorine; and carbon-source gas cylinder 1314 provides a gas containing carbon such as acetylene, methane, ethylene, propane, carbon dioxide, or ethane. Before entering reactor 1304, one or more of these gases are first deoxygenated by passing through an alkaline pyrogallol solution in containers 1316, concentrated sulphuric acid and calcium chloride in containers 1318, and potassium hydroxide in containers 1320. Subsequently, moisture is removed from the gases by passing them through a silica gel bed in container 1322. The gases directed entered in the reactor through three different non-return valves. The flow rates of gases directed toward reactor 1304 are measured by rotameter 1324, and the gas flow is controlled by non-return valves 1326. The gases are then mixed in mixing chamber 1308 before entering into reactor 1304.

In this embodiment, first, only the inert gas from cylinder 1310 is released and allowed to enter reactor 1304. The rate of inert gas flow may be kept constant at about 120 ml/min. After about 5 to 10 minutes, the reducing gas from cylinder 1312 is allowed to flow into reactor at the rate of about 5 to 25 ml/min for about 10 to 30 minutes. About 5 to 10 minutes thereafter, furnace temperature is increased to about 500° C.-900° C. After reactor 1304 reaches the increased temperature, carbon-containing gas is allowed to pass out from cylinder 1314 at the rate of about 10 to 200 ml/min. This flow rate of the carbon-containing gas may be held for about 1 to 30 minutes. Accordingly, the product of the CVD process performed by system 1300 is a CNT-coated tungsten filament. In other embodiments, other temperatures, times and/or flow rates for the CVD process may be used.

Additionally, a water-circulation arrangement is operatively arranged with reactor 1304 such that water is circulated between an entrance and an exit of reactor 1304 to maintain the reactor temperature at a desired level. Water from this arrangement may also be used as a coolant in condenser 1328. Any condensable material flowing out of reactor 1304 is collected in liquid collector 1330, whereas any non-condensable material is sent to the exit flow of reactor 1304 to be eventually released into the atmosphere.

In other embodiments, other techniques for coating CNTs on a tungsten filament may be used. Examples, include, but are not limited to, electric arc discharge technique, laser ablation method, thermal chemical vapor deposition (CVD) technique, plasma enhanced CVD technique, microwave CVD technique, microwave plasma enhanced CVD method, radio frequency plasma enhanced CVD method, cold plasma enhanced CVD method, laser assisted thermal CVD technique, catalytic CVD technique, low pressure CVD method, aero-gel supported CVD technique, vapor phase growth CVD technique, high pressure carbon monoxide disproportionation process (HIPCO), water assisted CVD technique, flame synthesis method, hydrothermal synthesis, electrochemical deposition technique, and pyrolytic method.

Characterization of CNT-Coated Filaments

Figure 14:
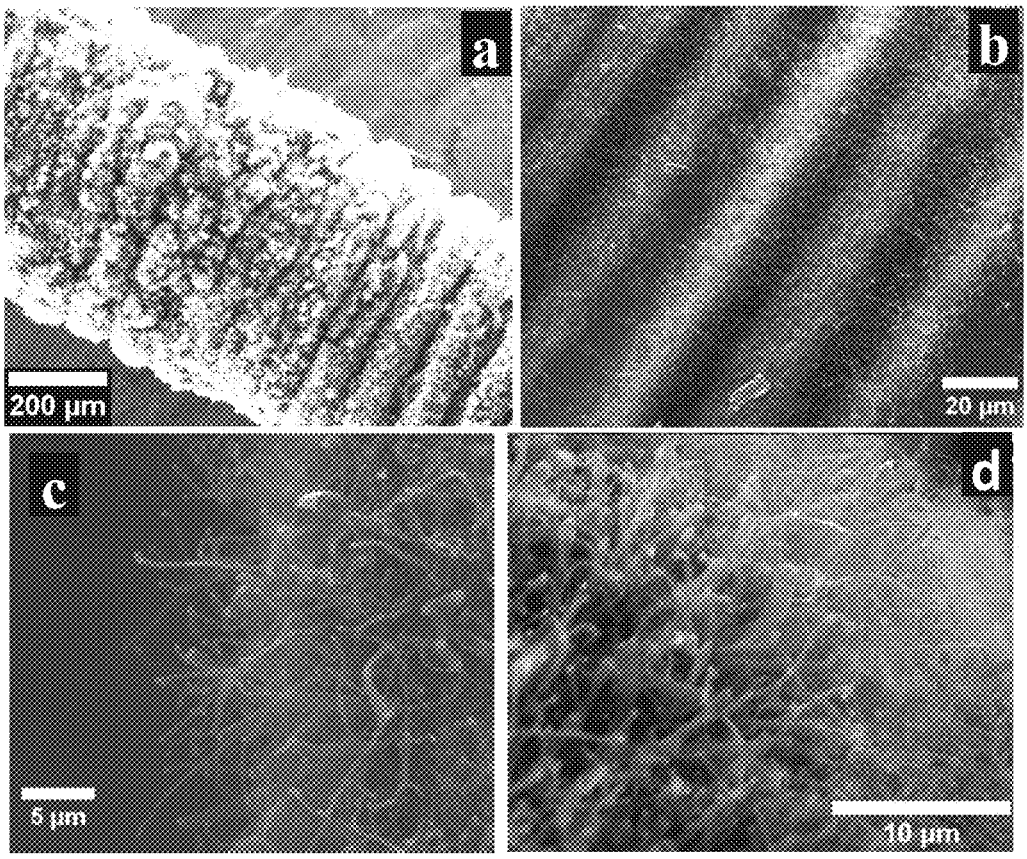
FIG. 14 shows SEM images for CNT-coated tungsten filament obtained after the coating process.

In one or more embodiments, the CNT-coated tungsten filaments are characterized and analyzed using SEM images and current-voltage analysis. FIG. 14 shows SEM images for CNT-coated tungsten filament obtained after the CVD coating process.

Figure 15A:
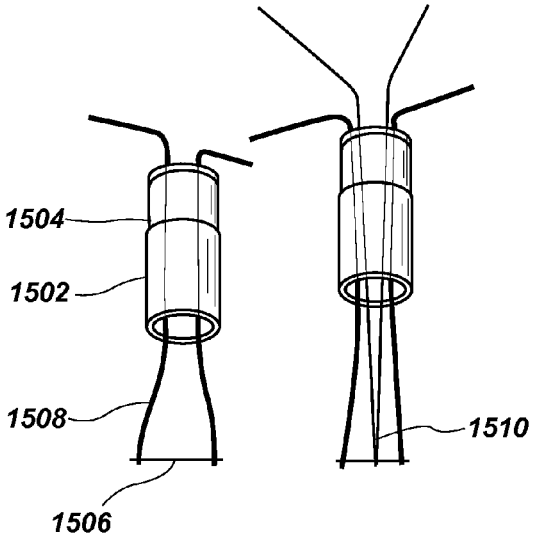
FIGS. 15*a-c* depict embodiments of a device including a CNT-coated tungsten filament.
Figure 15B:
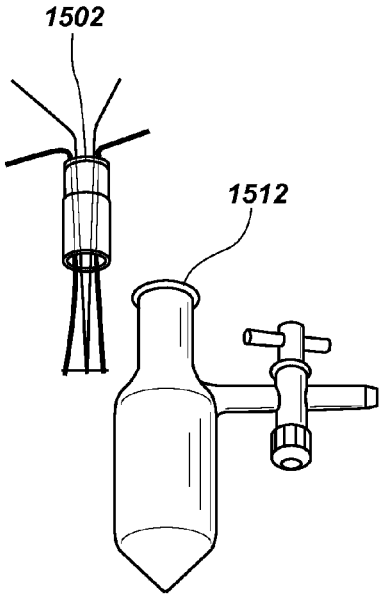
Figure 15C:
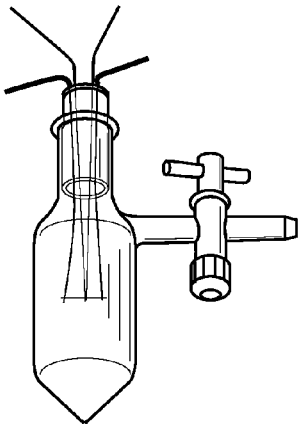

For current-voltage (I-V) analysis, example CNT-coated tungsten filament devices prepared, for example, using systems and processes described above are shown in FIGS. 15*a-c*. FIGS. 15*a-c* show a light bulb including a CNT-coated tungsten filament. Other devices employing a CNT-coated tungsten filament (as described above) may be manufactured and/or tested to characterize such filaments. FIG. 15*a* shows an upper part 1502 of the light bulb including a transparent glass tube 1504, CNT-coated/uncoated tungsten filament 1506, copper electrodes 1508 and optional temperature sensor 1510. As shown, the position of filament 1506 was kept fixed in between electrodes 1508. Filament 1506 may be positioned at any other location between electrodes 1508. FIG. 15*b* shows a glass covering part 1512 to cover part 1502 in the light bulb, and FIG. 15*c* shows a complete example light bulb with part 1502 being disposed in part 1512 such that electrodes 1502 and temperature sensor 1510 are disposed within the glass tube 1512. The pressure inside the example light bulb was kept in a range of about $10^3$ mbar to about $10^{-3}$ mbar. Other pressure values may be used. For the light bulb depicted in FIGS. 15*a-c*, the length of the bulb was chosen to be about 8 cm and an inner diameter was about 4 cm. Other geometries, or values of length, diameter or other dimensions of the light bulb may be used. The light bulb was configured such that the bulb may be operatively connected to an electrical system, such that when a voltage is applied between electrodes 1508, current may heat up filament 1506 resulting in light emission from the light bulb.

Figure 16:
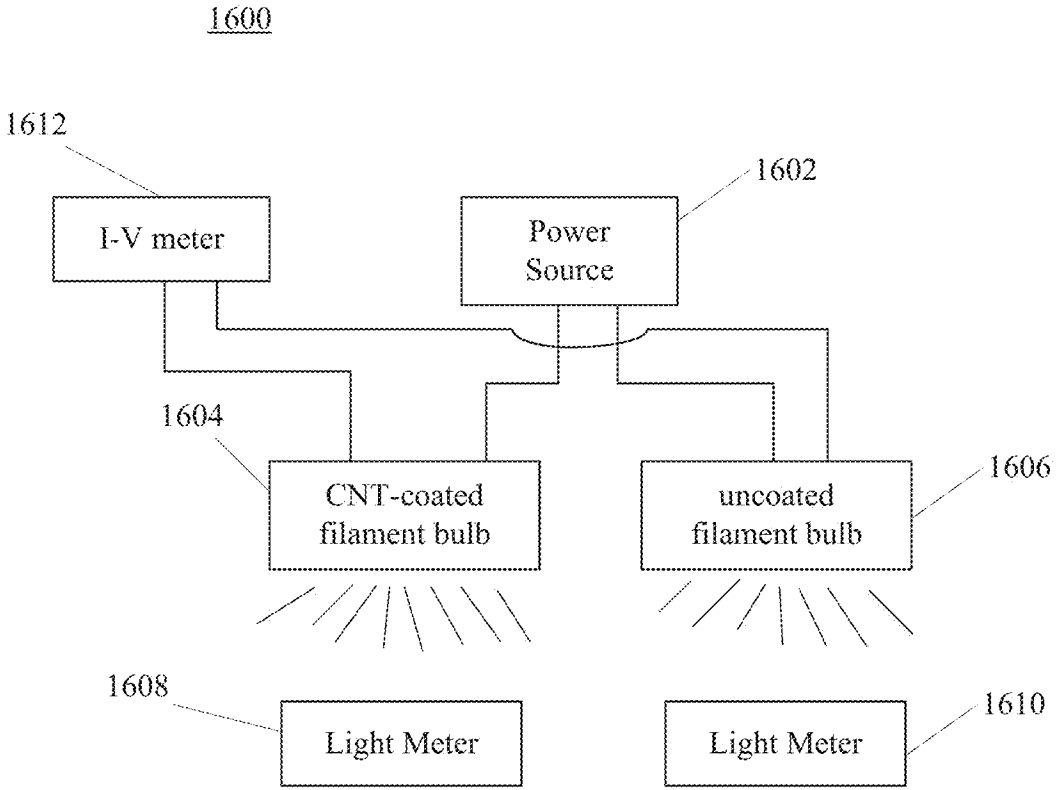
FIG. 16 is a schematic diagram of a system to compare and characterize a CNT-coated filament device with an uncoated filament device.

FIG. 16 shows a system 1600 for comparing and characterizing a light bulb including a CNT-coated tungsten filament with a conventional light bulb including an uncoated tungsten filament. Using system 1600, the goal was to analyze the two light bulbs in terms of their irradiative and electrical characteristics. System 1600 may include a power source 1602 operatively connected with a CNT-coated tungsten filament bulb 1604 and an uncoated tungsten filament bulb 1606. Power source 1602 provides a constant voltage signal (e.g., 5V, 15V, or 30V) to bulbs 1604, 1606 such that the electrical energy is converted into thermal energy due to the respective filaments, and light is emitted from bulbs 1604, 1606. The light irradiated by bulbs 1604, 1606 may be incident on and detected by light meters 1608, 1610, respectively. In one embodiment, light meters 1608, 1610 are positioned at a fixed and equal distance from their respective bulbs 1604, 1606, and are configured to measure the intensity of irradiance from bulbs 1604, 1606. Although two light meters are shown in FIG. 16, more or less than two meters may be used. A current-voltage (I-V) meter 1612 may be connected with bulbs 1604, 1606 to measure the current flowing through and/or voltage across light bulbs 1604, 1606. To achieve consistency in experimental results, identical conditions and environment may be provided to both bulbs 1604, 1606. For example, both bulbs may be manufactured with an equal vacuum of $10^{-3}$ mbar within (created, e.g., by a rotary pump), with an equal length of the CNT-coated and uncoated filaments in the respective bulbs, and with the equal exterior dimensions of bulbs 1604, 1606.

Using system 1600, various indices that may be recorded to compare the performance of bulbs 1604, 1606 may include irradiance, relative efficacy, and current-voltage (I-V) characteristics curve. As discussed above, the intensity of irradiance (lux) for both the bulbs may be measured by their respective light meters 1608, 1610. Relative efficacy (lux/watt) may be calculated as irradiance-to-power ratio. Relative efficacy may be analyzed for various values of applied voltage and/or for various values of applied power. I-V characteristic curves may be are measured for bulbs 1604, 1606 using I-V meter 1612.

Figure 17:
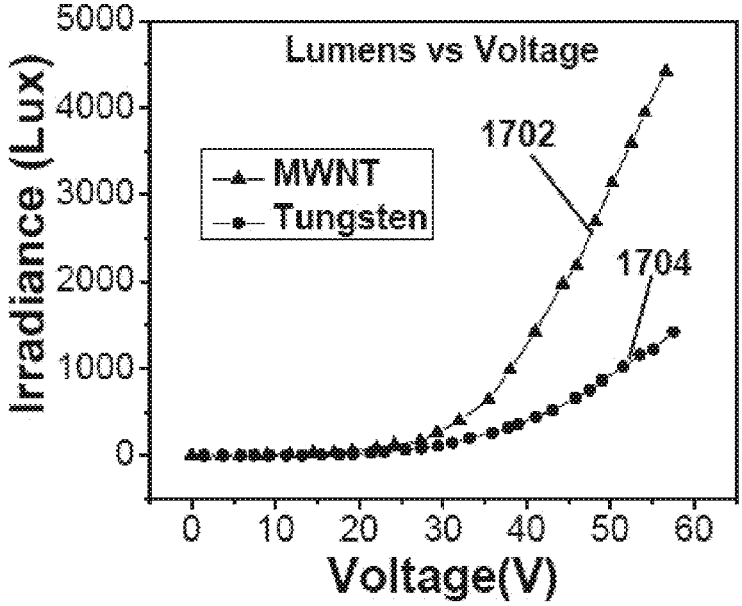
FIG. 17 shows various graphs depicting change in irradiance generated by a CNT-coated filament device and an uncoated filament device as a function of applied voltage.

FIG. 17 shows graph 1702 for bulb 1604 and graph 1704 for bulb 1606, both graphs indicating change of irradiance (lux) as a function of applied voltage. As is apparent, the irradiance of the CNT-coated filament bulb 1604 increases more rapidly as compared to the uncoated filament bulb 1606 with increase in voltage. It can also be seen that irradiance value of bulb 1604 at applied voltage equal to about 38V reaches about 980 lux, while for bulb 1606, the irradiance value for that voltage only reaches about 320 lux. Accordingly, it may be concluded that CNT-coated tungsten filament bulb 1604 emits more visible light as compared to uncoated tungsten filament bulb 1606 for the same applied voltage.

Figure 18A:
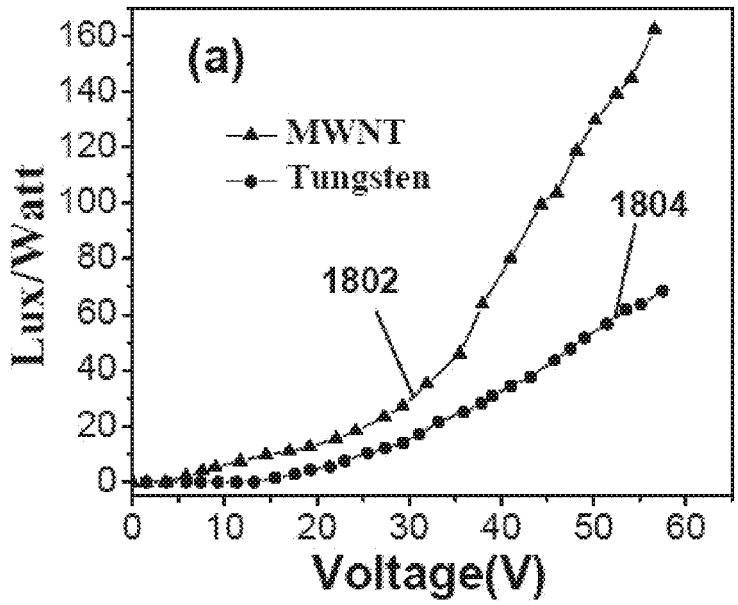
FIG. 18*a* shows various graphs depicting change in relative efficacy as a function of applied voltage for a CNT-coated filament device and an uncoated filament device.
Figure 18B:
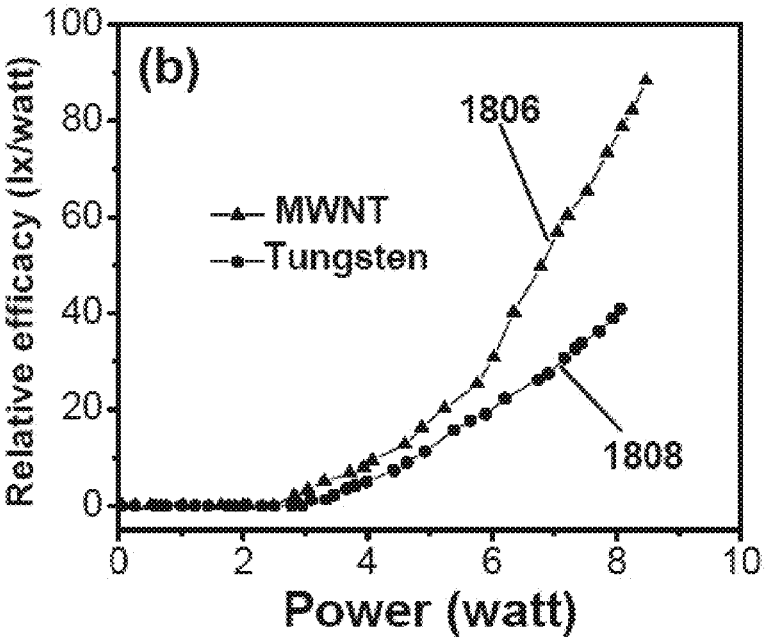
FIG. 18*b* shows various graphs depicting change in relative efficacy as a function of applied power for a CNT-coated filament device and an uncoated filament device.

FIG. 18*a* shows graphs of relative efficacy as a function of applied voltage for CNT-coated filament bulb 1604 (graph 1802) and for uncoated filament bulb 1606 (graph 1804). As can be seen, the relative efficacy of bulb 1604 increases much faster than that of bulb 1606 as the applied voltage increases. It was also observed that the efficacy of bulb 1604 is greatly increased when a higher voltage is applied. For example, the efficacy of bulb 1604 was measured to about 18.26 lx/W at about 24.2V, while the efficacy of bulb 1606 was measured equal to about 8.13 lx/W at the same applied voltage. Further at higher voltages, say about 50V, relative efficacy for bulb 1604 was measured as about 123.31 lx/W, while for bulb 1606, it merely reached about 20.29 lx/W. FIG. 18*b* graphs of relative efficacy as a function of applied power for CNT-coated filament bulb 1604 (graph 1806) and for uncoated filament bulb 1606 (graph 1808). As is apparent and like in the above-discussed voltage case, the relative efficacy for bulb 1604 increases much faster as compared to the relative efficacy for bulb 1606, with an increase in the applied power. It was observed that at the input power equal to about 5 W, the relative efficacy of bulb 1604 is about 17.39 lx/W, while for bulb 1606, it is about 5.43 lx/W. Moreover, it was observed that as the power is increased, the relative efficacy increases much faster. For example, at higher applied power, say about 8 W, the relative efficacy of the bulb 1604 reaches about 78.6 lx/W, much higher than that of bulb 1606, i.e. about 40 lx/W.

Figure 19:
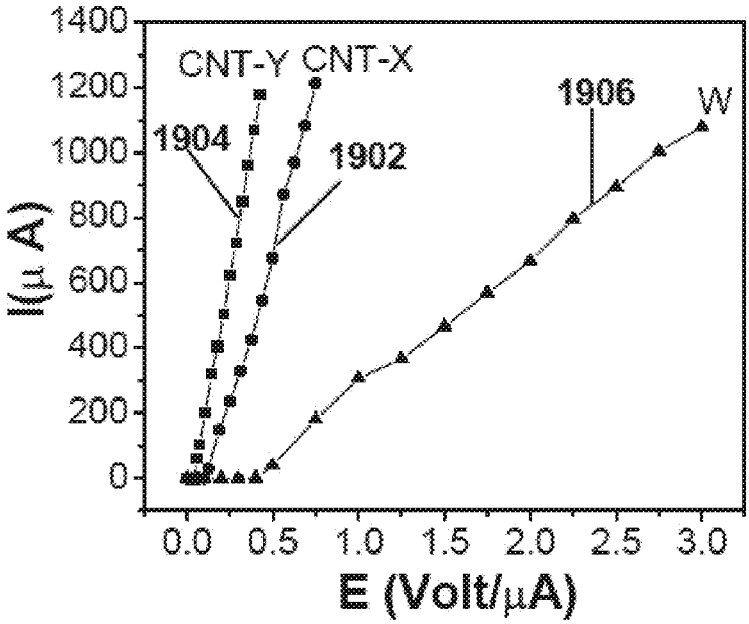
FIG. 19 shows various current-voltage (I-V) curves for a CNT-coated filament device and an uncoated filament device.

FIG. 19 shows I-V curves for CNT-coated filament bulb 1604 (graph 1902: mono catalyst; graph 1904: bicatalyst), and for uncoated filament bulb 1606 (graph 1906). As can be seen in FIG. 19, bulb 1604 provides higher brightness with higher operating current values for lower threshold voltage as compared to bulb 1606. Accordingly, it may be concluded that CNT-coated filament bulb 1604 is more energy-efficient than bulb 1606, and thus can be used as (or within) luminescent-source devices to replace conventional light bulbs (e.g., bulb 1606).

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed:

1. A device comprising:

a filament that includes carbon nanotubes, the carbon nanotubes comprising multiwall carbon nanotubes, wherein the device is configured to produce light with a luminary characteristic having a first value, wherein the first value is higher than a second value of the luminary characteristic of a device having an uncoated filament at a same operating condition; and a catalyst on the filament, the catalyst having a thickness in a range from about 50 nm to about 200 nm, and the filament having a diameter in a range from about 0.0030 cm to about 0.0102 cm;

wherein the filament is located in a sealed housing, an atmosphere in the housing at a pressure below $10^{-2}$ mbar; and wherein the filament is selected from a group consisting of a continuous flat multifilaments, continuous twisted multifilaments, and continuous textured multifilaments.

2. The device of claim 1, wherein the pressure is above $10^{-3}$ mbar.

3. The device of claim 1, wherein the filament comprises tungsten.

4. The device of claim 1, wherein the luminary characteristic includes device irradiance and the operating condition includes an applied voltage, and wherein for the applied voltage equal to about 38V, the first value of the device irradiance is about 980 lux and the second value of the device irradiance is about 320 lux.

5. The device of claim 1, wherein the luminary characteristic includes light efficiency (lx/W) and the operating condition includes an applied voltage or input power, wherein for the applied voltage selected from about 24.2V to about 50V, the first value of the light efficiency increases from about 18.26 lx/W to about 123.31 lx/W and the second value of the light efficiency increases from about 8.13 lx/W to about 20.29 lx/W; and for the input power selected from about 5 W to about 8 W, the first value of the light efficiency increases from about 17.38 lx/W to about 78.6 lx/W and the second value of the light efficiency increases from about 5.43 lx/W to about 40 lx/W.

6. A method comprising:

making a device comprising filament that includes carbon nanotubes, the carbon nanotubes comprising multiwall carbon nanotubes, wherein the device is configured to produce light with a luminary characteristic having a first value, wherein the first value is higher than a second value of the luminary characteristic of a device having an uncoated filament at a same operating condition; and adding a catalyst to the filament, the catalyst having a thickness in a range from about 50 nm to about 200 nm, and the filament having a diameter in a range from about 0.0030 cm to about 0.0102 cm;

wherein the filament is located in a sealed housing, an atmosphere in the housing at a pressure below $10^{-2}$ mbar; and wherein the filament is selected from a group consisting of a continuous flat multifilaments, continuous twisted multifilaments, and continuous textured multifilaments.

7. The method of claim 6, wherein the catalyst is incorporated in or on the filament by a process from a group consisting of electroless plating, electroplating, dip coating, spin coating, radio frequency (RF) sputtering, magnetron sputtering, electron beam evaporation, physical vapor deposition, thermal evaporation, chemical vapor deposition (CVD), combustion, co-precipitation, impregnation, and langmuir Blodgett.

8. The method of claim 7, further comprising exposing the filament to an oxidizing agent selected from a group consisting of metals, metal sulfides, metal disulfides, metal halides and metal sulphates, in which at least one metal is selected from a group consisting of Ni, Ru, Rh, Pd, Ir, Cr, Mo, W, and mixture thereof.

9. The method of claim 7, further comprising exposing the filament to a reducing agent selected from of a group consisting of metals, metal hydrides, metal hypophosphites, in which at least one metal is selected from a group consisting of Na, Mg, Al, Zn, Cu, and mixtures thereof.

10. The method of claim 7, further comprising exposing the filament to a chelating agent from a group consisting of carbohydrates, organic acids with more than one coordination group lipids, steroids, amino acids and related compounds, peptides, phosphate, nucleotides, tetrapyrrois, ferrioxamines, ionophores, gramicidin, monensin, valinomycin, phenolics, 2,2'-bipyridyldimercaptopropanol, ethylenedioxy-diethylene-dinitrilo-tetraacetic acid, ethylene,glycol-bis(2-aminoethyl)-N,N,N',N"-tetraacetic acid, lonophores-nitrilotrriacetic acid, NTA ortho-Phenanthroline, salicylic acid, triethanolamine, sodium succinate, sodium acetate, ethylene diamine, ethylenediaminetetraacetic acid, dethylenetriaminepentaacetic acid, ethylenedinitrilotetraatic acid, and mixtures thereof.

11. The method of claim 7, further comprising exposing the filament to a buffer solution comprising a weak acid, a salt of the weak acid and mixture thereof, in which weak acid is selected from a group consisting of succinic acid, formic acid, acetic acid, tricholoroacetic acid, hydrofluoric acid, hydrocynic acid, hydrogen sulphide, and mixtures thereof.

12. The method of claim 6, wherein making the device comprising the filament that includes the carbon nanotubes comprises coating the filament with the carbon nanotubes by a deposition technique selected from a group consisting of electric arc discharge, laser ablation, chemical vapor deposition (CVD), plasma enhanced CVD, microwave CVD, microwave plasma enhanced CVD, radio frequency plasma enhanced CVD, cold plasma enhanced CVD, laser assisted thermal CVD, catalytic CVD, low pressure CVD, aero-gel supported CVD, vapor phase growth CVD, high pressure carbon monoxide disproportionation (HIPCO), water assisted CVD, flame synthesis, hydrothermal synthesis, electrochemical deposition, a pyrolytic method, and combinations thereof.

13. The method of claim 12, wherein the CVD technique comprises exposing the filament to a gas selected from a group consisting of saturated hydrocarbons, aliphatic hydrocarbons, oxygenated hydrocarbons, aromatic hydrocarbons, alcohols, carbon monoxide, and mixtures thereof.

14. A device comprising:

a filament selected from a group consisting of a continuous flat multifilaments, continuous twisted multifilaments, and continuous textured multifilaments;

a catalyst on the filament, the catalyst having a thickness in a range from about 50 nm to about 200 nm; and carbon nanotubes formed on a surface of the filament, wherein the catalyst is configured to aid in formation of the carbon nanotubes;

wherein the catalyst comprises an alloy, the alloy comprising:

at least one first element from a group consisting of Ni, Ru, Rh, Pd, Ir, and Pt, and at least one second element selected from a group consisting of Cr, Mo, and W; and wherein a ratio of the second element to the first element in the alloy is greater than or equal to 2:1.

15. The device of claim 14, wherein the catalyst is either incorporated in the filament or a coating on the filament.

16. The device of claim 14, wherein the continuous multifilaments have lengths greater than approximately 10 mm.

17. The device of claim 16, wherein the continuous multifilaments have diameters in a range from about 0.0030 cm to about 0.0102 cm.

* * * * *

UNITED STATES PATENT AND TRADEMARK OFFICE

CERTIFICATE OF CORRECTION

PATENT NO. : 8,853,932 B2
APPLICATION NO. : 13/017303
DATED : October 7, 2014
INVENTOR(S) : Kar et al.

It is certified that error appears in the above-identified patent and that said Letters Patent is hereby corrected as shown below:

On the Title Page

On Page 2, in item (56), under "OTHER PUBLICATIONS", in Column 1, Line 5, delete ""Helicol" and insert -- "Helical --, therefor.

In the Drawings

In Fig. 3, Sheet 3 of 16, delete Main Designator "200" and insert Main Designator -- 300 --, therefor.

In Fig. 4, Sheet 4 of 16, for Tag "404", in Line 2, delete "Form s" and insert -- Form a Semi-solid Mass --, therefor.

In Fig. 9, Sheet 7 of 16, delete "Figure 9" and insert -- FIG. 9 --, therefor.

In Fig. 12, Sheet 9 of 16, delete "Figure 12" and insert -- FIG. 12 --, therefor.

In the Specification

In Column 2, Line 21, delete "filament" and insert -- filament. --, therefor.

In Column 2, Line 28, delete "FIG.12 a" and insert -- FIG.12 is a --, therefor.

Signed and Sealed this
Nineteenth Day of May, 2015

Michelle K. Lee

Michelle K. Lee
*Director of the United States Patent and Trademark Office*